US007709743B2

(12) United States Patent
Bernstorf et al.

(10) Patent No.: US 7,709,743 B2
(45) Date of Patent: May 4, 2010

(54) INTEGRATED INSULATOR SEAL AND SHIELD ASSEMBLIES

(75) Inventors: Robert A. Bernstorf, Wadsworth, OH (US); Bastiaan H. Van Besouw, Strongsville, OH (US)

(73) Assignee: Hubbell Incorporated, Orange, CT (US)

( * ) Notice: Subject to any disclaimer, the term of this patent is extended or adjusted under 35 U.S.C. 154(b) by 393 days.

(21) Appl. No.: 11/907,628

(22) Filed: Oct. 15, 2007

(65) Prior Publication Data

US 2009/0095506 A1 Apr. 16, 2009

(51) Int. Cl.
*H01B 17/42* (2006.01)

(52) U.S. Cl. ..... 174/140 R; 174/140 CR; 174/144; 174/188; 174/211; 174/158 R; 631/118; 439/882

(58) Field of Classification Search ..... 174/140 R, 174/140 CR, 144, 169, 179, 188, 176–178, 174/158 R, 211; 361/118; 439/882
See application file for complete search history.

(56) References Cited

U.S. PATENT DOCUMENTS 2,867,682 A 1/1959 Smith et al.
3,898,372 A * 8/1975 Kalb ..... 174/179
4,198,538 A 4/1980 Lusk
4,296,276 A * 10/1981 Ishihara et al. ..... 174/179
4,343,966 A * 8/1982 Pargamin ..... 174/140 S
4,427,843 A * 1/1984 Ishihara et al. ..... 174/140 S
4,476,081 A 10/1984 Kaczerginski et al.
4,604,498 A 8/1986 Kuhl
5,214,249 A 5/1993 Goch et al.
5,336,852 A 8/1994 Goch et al.
5,374,789 A 12/1994 Bernstorf
5,488,199 A 1/1996 Selsing et al.
5,563,379 A 10/1996 Kunieda et al.
5,914,462 A 6/1999 Fujii
6,265,669 B1 7/2001 Richards
6,384,338 B2 5/2002 Abe
6,388,197 B1 5/2002 Zhao et al.
6,472,604 B2 10/2002 Nakamura et al.
6,984,790 B1 1/2006 Bernstorf et al.

* cited by examiner

*Primary Examiner*—Dhiru R Patel
(74) *Attorney, Agent, or Firm*—Jenae C. Gureff; Mark S. Bicks; Alfred N. Goodman

(57) ABSTRACT

An integrated insulator sealing and shielding assembly includes a rubber housing having a plurality of radial weathersheds and a tapered end adjacent an endmost radial weathershed. A metal fitting is disposed adjacent to the endmost radial weathershed and receives the tapered end. A collar assembly is disposed at an upper end of the metal fitting and includes two apertures between an outer surface thereof and the rubber housing for receiving a sealant. At least one sealing surface, preferably four, is disposed between the collar assembly and a bottom end of the rubber housing for securing the connection therebetween.

22 Claims, 4 Drawing Sheets

INTEGRATED INSULATOR SEAL AND SHIELD ASSEMBLIES

FIELD OF THE INVENTION

The present invention relates to a collar assembly for an integrated insulator sealing and shielding assembly. More particularly, the invention represents an integrated insulator sealing and shielding assembly with a rubber housing having a plurality of radial weathersheds and a tapered end adjacent to the endmost radial weathershed. A metal fitting is disposed adjacent to the endmost radial weathershed and receives the tapered end of the rubber housing. A collar assembly surrounds the connection between the metal fitting and the rubber housing. The collar assembly further includes two apertures between an outer surface thereof and the rubber housing for receiving a sealant. There are preferably multiple sealing surfaces disposed between the collar assembly and a bottom end of the rubber housing for securing the connection therebetween.

BACKGROUND OF THE INVENTION

Electrical polymer insulators are used in power transmission and distribution systems to provide mechanical support for conductors and provide electrical insulation between the high voltage conductors and grounded tower structures. A corona protection device is located at the line end and/or the ground end of the insulator and eliminates the corona discharge from the insulator. Elimination of the corona discharge protects the surface of the insulator from polymeric material deterioration caused by electrical stress. Additionally, eliminating the corona discharge reduces television and/or radio noise created by the corona discharge.

One of the problems with conventional corona protection devices is the number of parts required to assemble the corona protection device, thereby increasing the manufacturing costs. Additionally, an installer must transport more parts to a job site, which decreases the speed and efficiency with which the corona protection devices may be installed. Since existing corona protection devices require various parts in order to completely assemble the device, if one part is lost or missing, the device cannot be properly assembled. Thus, an installer must make a return trip to finish installation of the corona discharge device. A need then exists for a collar assembly having few parts, thereby reducing manufacturing costs and providing quick installation.

Other problems with existing corona protection devices involve poor seals being formed between the corona protection device and the insulator, as well as the corona protection device being poorly secured to the insulator. Inadequate seals and connections to the insulators result in a highly ineffective corona protection device, often resulting in failure of the corona protection device. Thus, a need exists for a collar assembly having a good seal and connection to the insulator.

Examples of conventional corona protection devices include U.S. Pat. No. 2,867,682 to Smith et al.; U.S. Pat. No. 4,198,538 to Lusk; U.S. Pat. No. 5,488,199 to Selsing et al.; U.S. Pat. No. 6,265,669 to Richards; U.S. Pat. No. 6,388,197 to Zhao et al.; the subject matter of each of which is hereby incorporated by reference.

Conventional external metal collars clamp down on a cylindrical polymer surface to create a void in the sealing system. Accordingly, a need exists for an improved insulator collar assembly having a metal fitting and a rubber housing forming a compression seal to an external stationary cylindrical metal element.

SUMMARY OF THE INVENTION

Accordingly, an object of the invention is to provide an improved insulator sealing and shielding assembly.

Another object of the invention is to provide an insulator shielding having a collar assembly disposed between a rubber housing and a metal fitting where the collar includes at least one opening for receiving a sealant.

A further object of the invention is to provide an insulator shielding with a rubber housing tapered into a metal fitting to increase the compression connection therebetween.

Still another object of the invention is to provide an insulator shielding with a plurality of equidistant radial weathersheds disposed along an exterior of the housing and the endmost weathershed adjacent to the collar assembly connected to the hardware.

The foregoing objects are basically attained by providing an insulator shielding having a rubber housing with a plurality of weathersheds and a tapered end adjacent the metal fitting. Four sealing surfaces between the counterbore of the collar assembly and the rubber housing secure the connection therebetween creating an integral metal fitting and rubber housing. The collar assembly comprises at least one aperture for receiving a sealant that creates a mold to help secure the connection.

By forming the insulator sealing and shielding assembly in this manner, a sealant can be dispensed into one of the apertures until the collar assembly is full of sealant to create a first seal. Three additional sealing surfaces protect the initial seal against moisture ingress and seal the flow channel to effectively bond the rubber housing and metal fitting.

As used in this application, the terms "top", "bottom", and "side" are intended to facilitate the description of the invention, and are not intended to limit the present invention to any particular orientation.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to drawings that form a part of this disclosure.

Throughout the drawings, like reference numerals will be understood to refer to like parts, components, and structures.

DETAILED DESCRIPTION OF THE INVENTION

Figure 1:
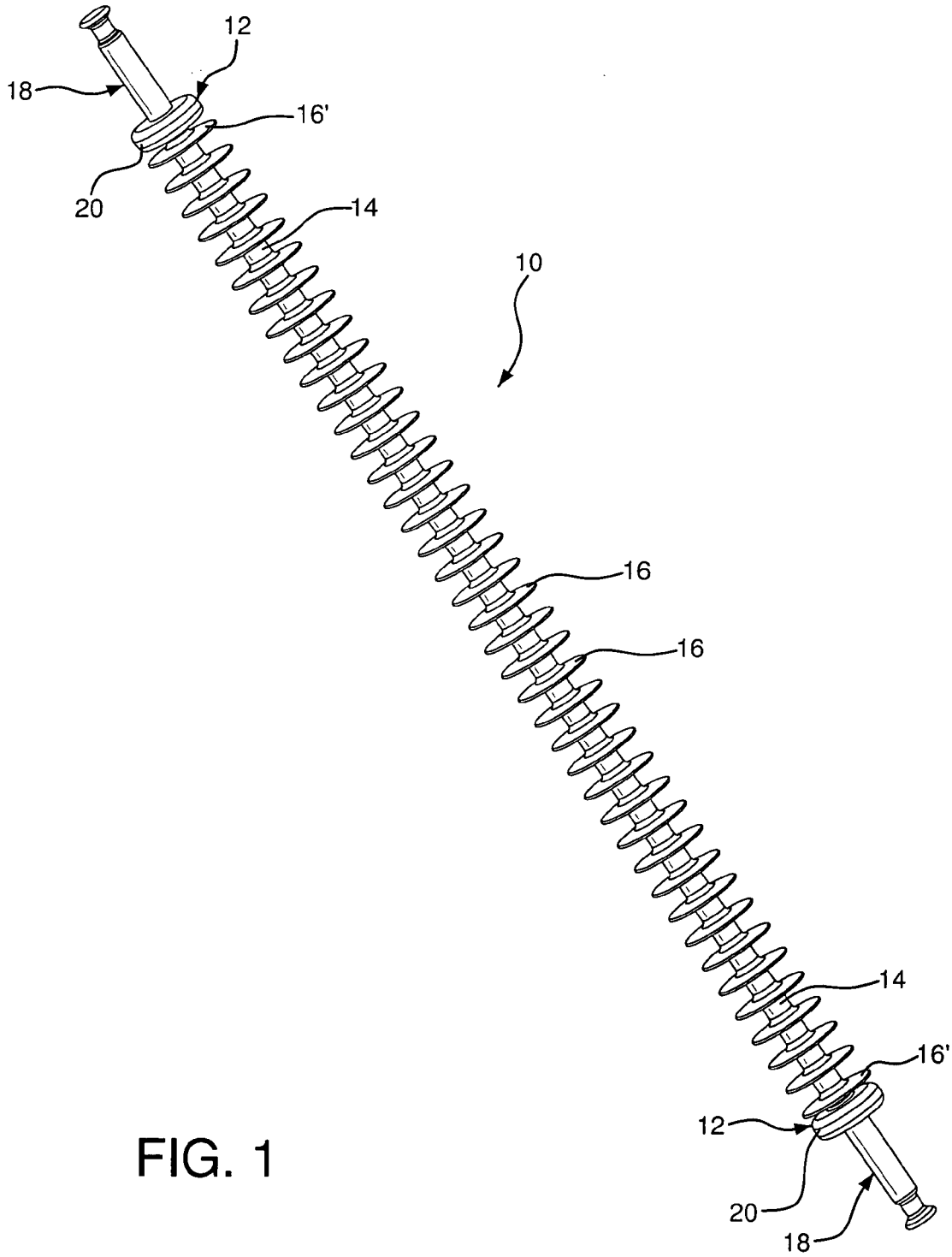
FIG. 1 is a perspective view of the insulator sealing and shielding assembly according to an embodiment of the present invention.

Referring to FIGS. 1-4, an insulator sealing and shielding assembly 10 includes an annular collar assembly 12 disposed below a tubular rubber or polymer housing 14 with a plurality of weathersheds 16, and a metal fitting 18 with a collar assembly 12 at each end of the rubber housing 14. The rubber housing 14 includes a plurality of radial weathersheds 16 evenly disposed about the housing 14 in a columnar arrangement. The extended portion of each metal fitting 18 away from the weathershed housing is disposed on the opposite side of the collar assembly 12 relative to the rubber housing 14.

Ultimately, the rubber housing 14 is adapted to be inserted into and connected to each metal fitting 18 under pressure. Since each metal fitting 18 and collar assembly 12 is identical, only one will be described in detail.

The weathersheds 16 are spaced apart equal distances from one another along the body of the insulator assembly 10. All weathersheds 16 have the same diameter. At the outer edge of the axially endmost weathershed 16', the end 30 of the rubber housing 14 tapers towards the side of the assembly 10 with the metal fitting 18. The endmost weathershed 16' is adjacent to and abuts the collar assembly 12, further illustrated in FIGS. 3 and 4.

Figure 2:
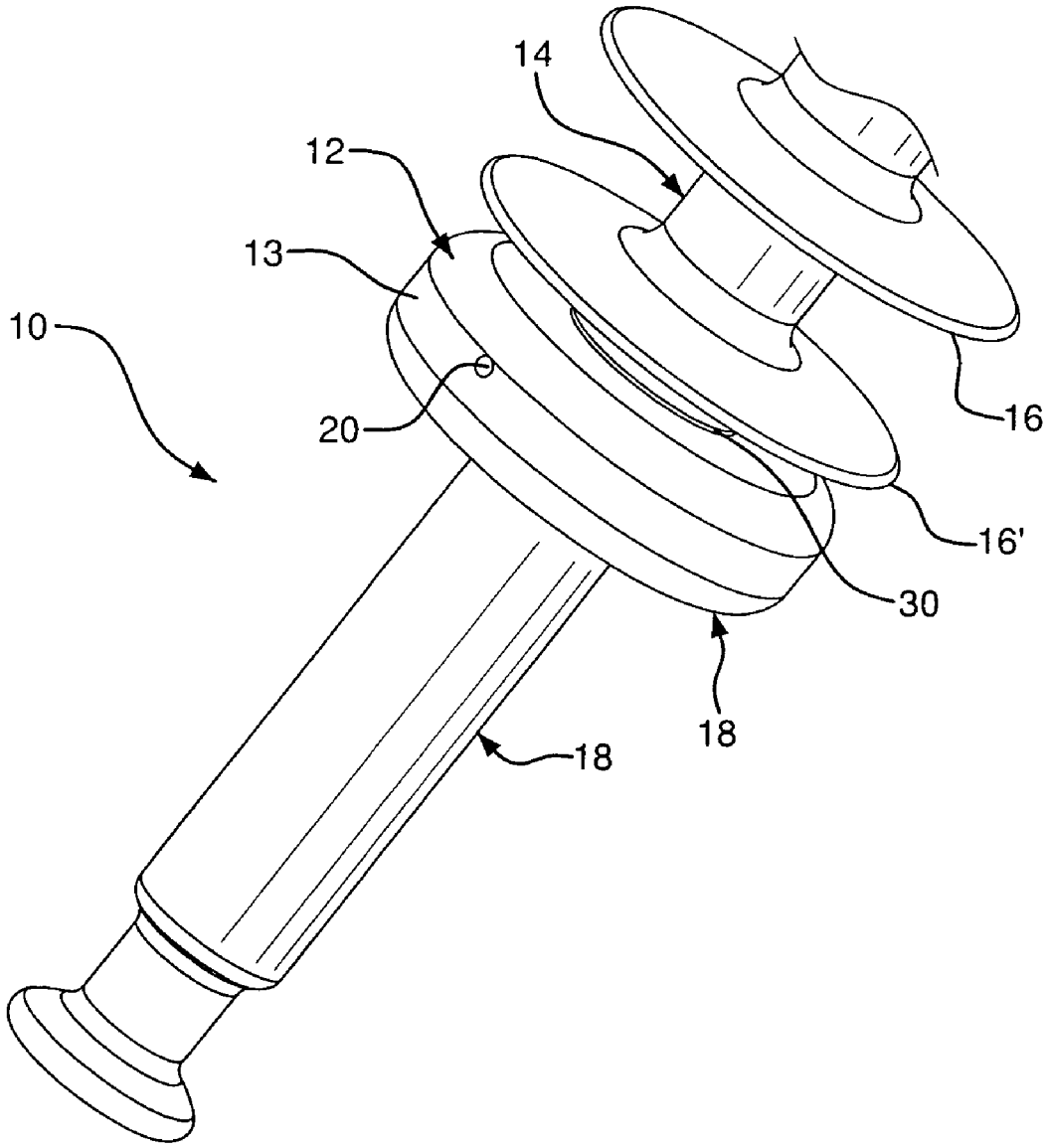
FIG. 2 is an enlarged perspective view of the end portion of the metal fitting and rubber housing of one end of the insulator sealing and shielding assembly shown in FIG. 1.
Figure 3:
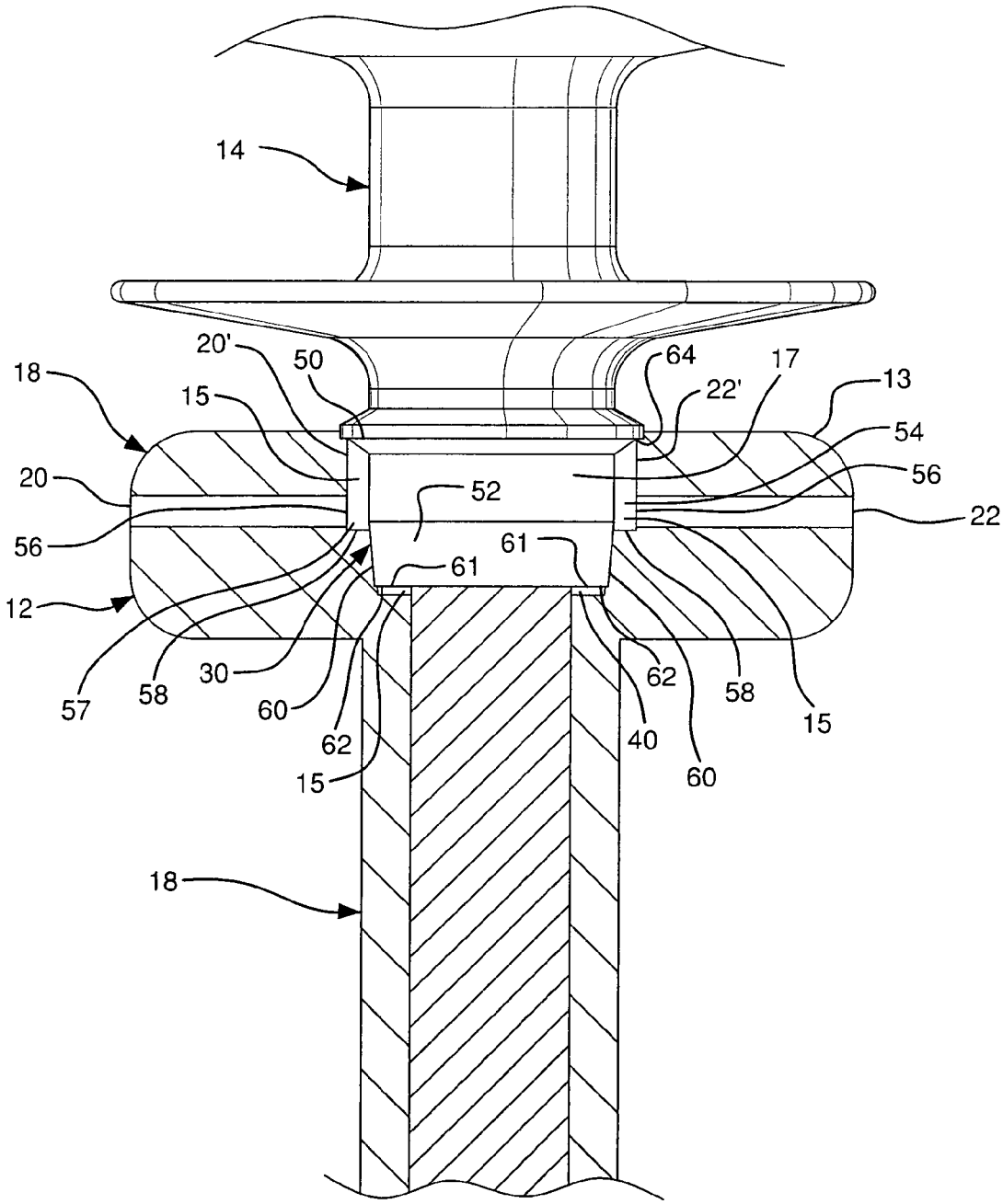
FIG. 3 is a partial side elevational view in section of the insulator sealing and shielding assembly of FIGS. 1 and 2.

The collar assembly 12 surrounds the interface between the metal fitting 18 and the rubber housing 14, as shown in FIGS. 2 and 3. Such collar assemblies are disclosed in U.S. Pat. No. 6,984,790 to Bernstorf, the subject matter of which is hereby incorporated by reference. The present invention creates a similar void by using a concentric cylindrical polymer surface to form compression seals adjacent to an external stationary cylindrical metal part.

Turning to FIG. 2, the collar assembly 12 has an outer surface 13 with a first aperture 20 and a second aperture 22 for receiving a material injected therein. First aperture 20 is drilled at the widest part of the diameter of the collar assembly 12, and extends between the endmost extension or outer surface 13 of the collar assembly 12 and the tapered end 30 of the rubber housing 14. Second aperture 22, similarly shaped, is disposed on the opposite side of the first aperture 20, and extends between the outer surface 13 of the collar assembly 12 to the tapered end 30 of the rubber housing 14.

The collar assembly 12 also includes a counterbore 15 that receives the tapered end 30. The counterbore 15 is a passage extending between the first and second apertures 20, 22 and adjacent to the tapered end 30 of the rubber housing 14. This helps create the connection between the collar assembly 12 and the rubber housing 14.

Each aperture 20, 22 makes up the counterbore 15 passing lengthwise along the diameter of the collar assembly 12. The counterbore 15 is the main opening between the rubber housing 14 and the metal fitting 18.

Figure 4:
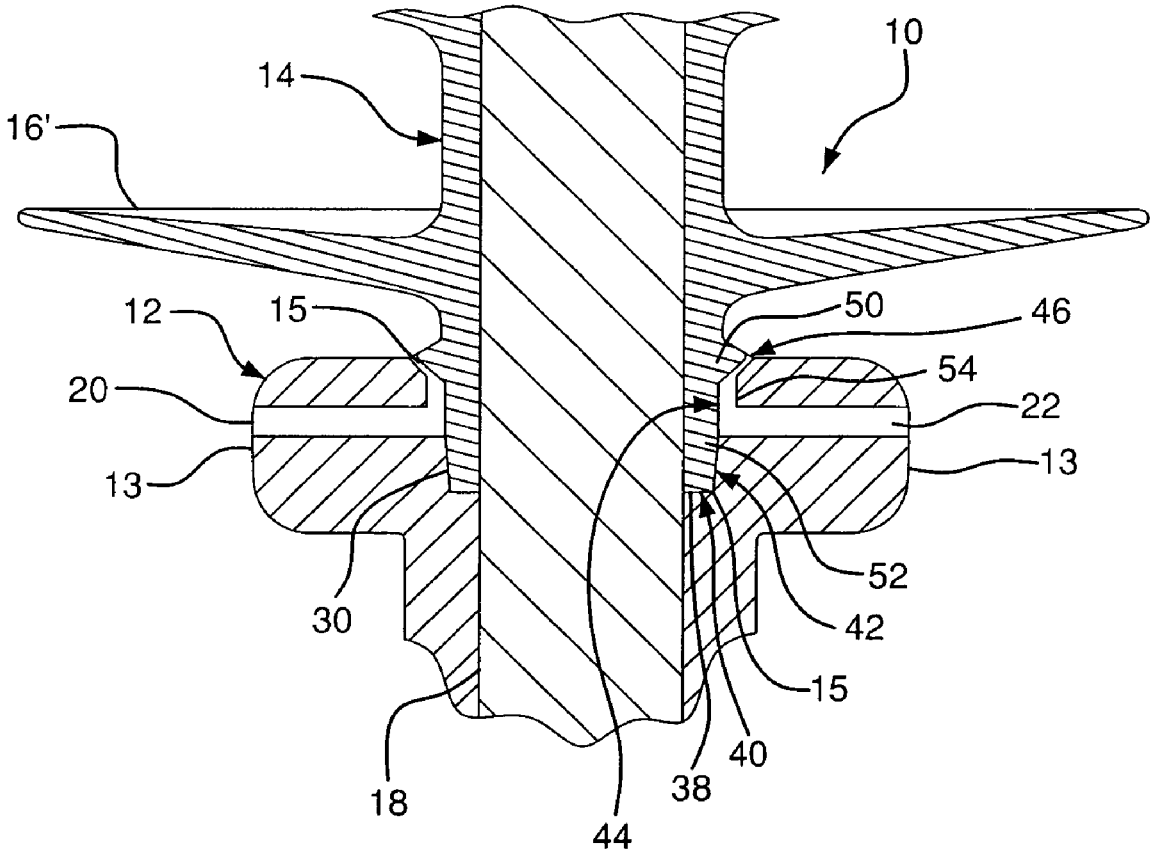
FIG. 4 is a partial elevational view in section of the insulator sealing and shielding assembly of FIGS. 1-3, specifically illustrating the four sealing surfaces.

As seen in FIGS. 3 and 4, the tapered end 30 of the rubber housing 14 is coupled to the collar assembly 12 at a narrow junction 40 therebetween. This is the lowermost area of the counterbore 15. The tapered end 30 is located adjacent, but spaced from, the lowermost point of the counterbore 15 for creating at least one sealing surface with the collar assembly 12. This junction 40 between the tapered end 30 and the collar assembly 12 represents one of four sealing surfaces securing the assembly 10. More specifically, the sealing surfaces are disposed between the collar assembly 12 and a bottom end 17 of the rubber housing 14. Junction 40 helps to create a seal between the outer surface of the rubber housing 14 and the counterbore 15 of the metal fitting 18. Specifically, the first seal or junction 40 is the joint between the end 38 of the counterbore 15 and the tapered end 30 of the rubber housing 14.

As seen in FIG. 4, the second sealing surface 42 is located slightly above the first seal 40. The second seal 42 is a radial compression seal created by pushing the frustum or first frustum 52 of the rubber housing 14 into the frustum or second frustum 54 of the counterbore 15. Turning to FIG. 3, the counterbore frustum 54 includes first and second walls 56, 58 and the rubber housing frustum 52 includes first and second walls 60, 62. The angles 57 between the walls 56, 58 of the counterbore's frustum are larger than the angles 61 between walls 60, 62 of the rubber housing 14, imparting increasing compressing force between the rubber housing 14 and the counterbore 15.

The third sealing surface 44 is located towards the intersection of the second aperture 22 and the rubber housing 14. This is known as the room temperature vulcanizing (RTV) fill because material is injected into the first aperture 20 between the rubber housing 14 and the collar assembly 12. Each aperture 20, 22 is defined by a perpendicular extension or projection 20', 22', respectively, that extends towards the plurality of weathersheds 16. These extensions 20', 22' of the apertures 20, 22, respectively connect the apertures 20, 22 to the tapered end 30 of the rubber housing 14. This connection assists in creating a mold because the openings 20, 22 and 20', 22' receive the sealant material between the rubber housing 14 and the collar assembly 12 and shape the cast of the sealant material or RTV. RTV is preferred material because it bonds to silicone rubber and metals.

The material injected is a sealant which may be either a room temperature or high temperature vulcanizing material. Sealant is pumped into the fitting at the first aperture 20 until enough sealant is disposed or stored in both the first aperture 20 and the second aperture 22 and sealant overflows. When the maximum limit of sealant has been reached, excess sealant begins to emerge and overflows from the opposite aperture 22 so the installer knows a sealed fit has been formed within the interior of the metal fitting 18, thus creating the third sealing surface 44.

The fourth sealing surface 46 is located towards the top of the collar assembly 12 at the junction of the rubber housing 14 and the outer portion 64 of the counterbore 15. This sealing surface 46 is the lip seal defined by the intersection of a raised rib 50 on the rubber housing 14 and the outer portion of the counterbore 15 to provide an initial seal against moisture ingress. It also seals the flow channel to keep the RTV adjacent to the rubber housing 14 until it cures. The raised rib 50 is the lowermost extension of the rubber housing 14 on the side of the endmost weathershed 16' adjacent the collar assembly 12.

While a particular embodiment has been chosen to illustrate the invention, it will be understood by those skilled in the art that various changes and modifications can be made therein without departing from the scope of the invention as defined in the appended claims.

What is claimed is:

1. An insulator shielding assembly, comprising:

a rubber housing having a plurality of radial weathersheds and a tapered end adjacent an endmost radial weathershed;

a metal fitting disposed adjacent to said endmost radial weathershed and receiving said tapered end;

a collar assembly disposed at an upper end of said metal fitting including at least one aperture between an outer surface thereof and said rubber housing; and at least one sealing surface disposed between said collar assembly and a bottom end of said rubber housing.

2. An insulator shielding assembly according to claim 1 wherein each of said plurality of weathersheds includes an equal distance therebetween.

3. An insulator shielding assembly according to claim 1 wherein said collar assembly includes a counterbore extending between first and second apertures and is adapted to receive said tapered end.

4. An insulator shielding assembly according to claim 3 wherein said tapered end is located adjacent a lowermost point of said counterbore for creating said at least one sealing surface with said collar assembly.

5. An insulator shielding assembly according to claim 3 wherein said apertures are disposed along said outer surface and extend towards said rubber housing along a radial distance of said collar assembly, said apertures receiving a sealant.

6. An insulator shielding assembly according to claim 3 wherein said second aperture is located along said outer surface directly opposite said first aperture.

7. An insulator shielding assembly according to claim 1 wherein a sealant is injected into said at least one aperture.

8. An insulator shielding assembly according to claim 7 wherein said sealant is a vulcanizing material with a temperature greater than or equal to a room temperature.

9. An insulator shielding assembly according to claim 3 wherein a sealant is injected into first aperture until said sealant is disposed within first and second apertures creating said at least one sealing surface.

10. An insulator shielding assembly according to claim 3 wherein said at least one sealing surface is a radial compression seal located between a first frustum of said rubber housing and a second frustum of said counterbore.

11. An insulator shielding assembly according to claim 10 wherein said counterbore frustum includes first and second counterbore walls and said rubber housing frustum includes first and second rubber housing walls wherein the angles between said counterbore walls are larger than the angles between said rubber housing walls.

12. An insulator shielding assembly according to claim 1 wherein said at least one sealing surface is a lip seal defined by the intersection of a raised rib on said rubber housing and an outer portion of said counterbore.

13. An insulator shielding assembly according to claim 3 wherein a sealant is injected into said first aperture.

14. An insulator shielding assembly according to claim 13 wherein said sealant is a vulcanizing material with a temperature greater than or equal to a room temperature.

15. An insulator shielding assembly, comprising:

a rubber housing having a plurality of radial weathersheds and a tapered end adjacent an endmost radial weathershed;

a metal fitting disposed adjacent to said endmost radial weathershed and receiving said tapered end;

a collar assembly disposed at upper end of said metal fitting including first and second apertures between an outer surface thereof and said rubber housing and a counterbore extending between said apertures; and first and second sealing surfaces disposed between said collar assembly and a bottom end of said rubber housing.

16. An insulator shielding assembly according to claim 15 wherein said tapered end is located adjacent a lowermost point of said counterbore for creating said first and second sealing surfaces with said collar assembly.

17. An insulator shielding assembly according to claim 15 wherein said first and second apertures contain a sealant injected therebetween forming said first sealing surface.

18. An insulator shielding assembly according to claim 17 wherein said second sealing surface is a radial compression seal located between a first frustum of said rubber housing and a second frustum of said counterbore.

19. An insulator shielding assembly according to claim 18 wherein said counterbore frustum includes first and second counterbore walls and said rubber housing frustum includes first and second rubber housing walls wherein the angles between said counterbore walls are larger than the angles between said rubber housing walls.

20. An insulator shielding assembly, comprising:

a rubber housing having a plurality of radial weathersheds and a tapered end adjacent an endmost radial weathershed;

a metal fitting disposed adjacent to said endmost radial weathershed and receiving said tapered end;

a collar assembly disposed at an upper end of said metal fitting including first and second apertures between an outer surface thereof and said rubber housing and a counterbore extending between said apertures and adjacent said tapered end for creating first sealing surfaces with said rubber housing; and second, third, and fourth sealing surfaces disposed between said collar assembly and a bottom end of said rubber housing.

21. An insulator shielding assembly according to claim 20 wherein said second sealing surface is a radial compression seal located between a first frustum of said rubber housing and a second frustum of said counterbore; and said third sealing surface includes a sealant injected into first aperture until said sealant is disposed within said first and second apertures.

22. An insulator shielding assembly according to claim 21 wherein said fourth sealing surface is a lip seal defined by the intersection of a raised rib on said rubber housing and an outer portion of said counterbore.

* * * * *